US009839803B2

(12) United States Patent
Richard et al.

(10) Patent No.: US 9,839,803 B2
(45) **Date of Patent: *Dec. 12, 2017**

(54) FREE-STANDING FITNESS DEVICE

(71) Applicant: Xelerator Fitness, LLC, San Jose, CA (US)

(72) Inventors: Ronney Richard, San Jose, CA (US); Kevin Dowling, San Jose, CA (US); Edward Kelley, San Jose, CA (US); Brad Richardson, Mountain View, CA (US)

(73) Assignee: XELERATOR FITNESS, LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/050,730

(22) Filed: Feb. 23, 2016

(65) Prior Publication Data

US 2016/0271435 A1 Sep. 22, 2016

Related U.S. Application Data

(63) Continuation of application No. 13/886,422, filed on May 3, 2013, now Pat. No. 9,265,987.

(51) Int. Cl.
*A63B 1/00* (2006.01)
*A63B 23/02* (2006.01)
(Continued)

(52) U.S. Cl.
CPC ..... *A63B 1/00* (2013.01); *A63B 21/068* (2013.01); *A63B 21/0628* (2015.10); *A63B 21/169* (2015.10); *A63B 22/0076* (2013.01); *A63B 23/02* (2013.01); *A63B 23/03516* (2013.01); *A63B 23/1218* (2013.01); *A63B 23/1254* (2013.01); *A63B 21/008* (2013.01); *A63B 21/0085* (2013.01); *A63B 21/00181* (2013.01); *A63B 21/023* (2013.01);
(Continued)

(58) Field of Classification Search
CPC . A63B 1/00; A63B 23/03516; A63B 23/1218; A63B 23/1254; A63B 23/02; A63B 22/0076; A63B 21/068; A63B 21/169; A63B 21/0628; A63B 21/4047; A63B 21/008; A63B 21/00181; A63B 21/023; A63B 21/0085; A63B 24/0087; A63B 2022/0084; A63B 2208/0214; A63B 2208/0204
See application file for complete search history.

(56) References Cited

U.S. PATENT DOCUMENTS 5,037,089 A * 8/1991 Spagnuolo ..... A63B 21/0628 482/100
5,407,404 A * 4/1995 Killian ..... A63B 21/4047 482/123
(Continued)

*Primary Examiner* — Loan H Thanh
*Assistant Examiner* — Megan Anderson
(74) *Attorney, Agent, or Firm* — Convergent Law Group LLP

(57) ABSTRACT

The present invention relates to an improved fitness device; specifically, the present invention relates to a stationary fitness machine designed to strengthen multiple muscle groups including the abdominal, chest, intercoastal, latissimus dorsi, rhomboid, deltoid, bicep, forearm, oblique and gluteus maximus muscles using a unique, advanced, combined pull-up, fly movement.

21 Claims, 8 Drawing Sheets

(51) Int. Cl.

| | |
|---|---|
| ***A63B 21/068*** | (2006.01) |
| ***A63B 23/12*** | (2006.01) |
| ***A63B 21/062*** | (2006.01) |
| ***A63B 21/16*** | (2006.01) |
| ***A63B 22/00*** | (2006.01) |
| ***A63B 23/035*** | (2006.01) |
| *A63B 21/008* | (2006.01) |
| *A63B 21/02* | (2006.01) |
| *A63B 21/00* | (2006.01) |
| *A63B 24/00* | (2006.01) |

(52) U.S. Cl.

CPC ..... *A63B 21/4047* (2015.10); *A63B 24/0087* (2013.01); *A63B 2022/0084* (2013.01); *A63B 2208/0204* (2013.01); *A63B 2208/0214* (2013.01)

(56) References Cited

U.S. PATENT DOCUMENTS

| | | | | | |
|---|---|---|---|---|---|
| 5,613,928 | A * | 3/1997 | Laudone | A63B 23/03525 | 482/100 |
| 5,665,036 | A * | 9/1997 | Hsieh | A63B 23/00 | 482/100 |
| 6,234,941 | B1 * | 5/2001 | Chu | A63B 23/12 | 482/100 |
| 2013/0102443 | A1 * | 4/2013 | Lundquist | A63B 21/068 | 482/93 |

* cited by examiner

FREE-STANDING FITNESS DEVICE

CROSS-REFERENCE TO RELATED APPLICATIONS

The present application is a continuation of U.S. Ser. No. 13,886,422, which will issue Feb. 23, 2016 as U.S. Pat. No. 9,265,987.

STATEMENT REGARDING FEDERALLY SPONSORED RESEARCH OR DEVELOPMENT

This invention was made without the support of the Federal Government.

FIELD OF THE INVENTION

The present invention relates to an improved fitness device; specifically, the present invention relates to a fitness machine designed to strengthen multiple muscle groups using a unique, combined pull-up/fly movement.

BACKGROUND OF THE INVENTION

In the following discussion, certain exercise and fitness systems will be described for background and introductory purposes. Nothing contained herein is to be construed as an "admission" of prior art. Applicant expressly reserves the right to demonstrate, where appropriate, that the articles and methods referenced herein do not constitute prior art under the applicable statutory provisions.

Exercising machines employing suspended weights for providing a resistance to body motions are well known in the art. These machines generally include a frame supporting weights attached to a tether. The tether is connected, in turn, to levers and similar components which are grasped by a user and manipulated. Manipulation against the resistance of the weights forces muscles to exert great effort, and thus increases the strength and/or bulk of the muscles over time.

However, compound motions are seldom supported by weight or fitness machines. Compound motions are desirable since they can parallel natural body movement, and enable exercising muscles and groups of muscles that frequently cannot be properly exercised by simple motions. The reason compound motions tend to be ignored and not supported by fitness equipment is that compound motions—particularly advanced compound motions—frequently require great complexity in a machine. For example, a lever may require pivoting about plural axes, or a compound motion may require substantial linear movement followed by a rotating movement. Any combination of these and other motions may be required, and may be further complicated by the requirement for gradual transition from one motion to the next or for a configuration that assures substantial symmetry of movement.

What has not been available until now is a stationary fitness device that, in one combined movement, works a myriad of muscle groups including the abdominal, chest, intercoastal, latissimus dorsi, rhomboid, deltoid, bicep, forearm, oblique and gluteus maximus muscles. The present invention meets this unmet need.

SUMMARY OF THE INVENTION

This Summary is provided to introduce a selection of concepts in a simplified form that are further described below in the Detailed Description. This Summary is not intended to identify key or essential features of the claimed subject matter, nor is it intended to be used to limit the scope of the claimed subject matter. Other features, details, utilities, and advantages of the claimed subject matter will be apparent from the Detailed Description herein including those aspects illustrated in the accompanying drawings and defined in the appended claims.

The present invention relates to an improved fitness device; specifically, the present invention relates to a stationary fitness machine designed to strengthen multiple muscle groups including the abdominal, chest, intercoastal, latissimus dorsi, rhomboid, deltoid, bicep, forearm, oblique and gluteus maximus muscles using a unique, advanced combined pull-up, fly movement.

Thus, the present invention provides a free-standing, suspended, or wall/door mountable, fitness device for use in performing a combination pull-up and fly movement. In one embodiment, the device is free-standing and comprises a floor-engaging member coupled to a central vertical support; and a horizontal pull-up bar able to support at least 400 pounds of weight securely coupled by a central pivot portion to the central vertical support at a height of at least 5' 9" from the floor engaging member, wherein the horizontal pull-up bar comprises a right bar member and a left bar member, and wherein the right bar member and the left bar member are pivotally connected to the central pivot portion such that the right bar member and the left bar member may be resistively moved simultaneously from an original position 180° relative to one another to a position 90° forward from the original position.

In some aspects of this embodiment, the floor-engaging member comprises a right floor engaging member, a left floor-engaging member and a cross floor engaging member that couples the right and left floor-engaging members; and in some aspects, the central vertical support member further comprises a left outer vertical support, a right outer vertical support and a cross bar support, wherein the cross bar support couples the central vertical support member to the left outer vertical support and the right outer vertical support. In some aspects, the right outer vertical support is coupled to the right floor-engaging member, and the left outer vertical support is coupled to the left floor-engaging member.

In some aspects of this embodiment, the right and left bar members comprise handle grips, and in some preferred aspects, the right and left bar members comprise forearm rests.

In preferred aspects of this embodiment of the invention, the resistive movement can be adjusted to increase resistance, where in some configurations the resistance can be adjusted manually and in other configurations the resistance can be adjusted digitally. Resistance can be imparted using, e.g., free weights, weight bands, pulley systems, springs, hydraulic and/or pneumatic systems as are known in the art.

In some aspects of this embodiment of the invention, at least one back bracing plate is included on the device, and in other aspects, two or more back bracing plates are included. In preferred embodiments, the one or more back bracing plates are padded.

Some aspects of the free-standing fitness device include the horizontal pull-up bar securely coupled to the central vertical support at a height of about 5' 11" from the floor engaging members, 6' from the floor engaging members, 6' 1" from the floor engaging members, 6' 2", 6' 3", 6' 4", 6' 5" or more from the floor engaging members. In some aspects, the horizontal pull-up bar is able to support at least 600, 700, 750, 800, or 900 pounds of weight or more.

In some aspects, the free-standing fitness device comprises lift assistance able to support up to 50% or of a user's weight during a pull-up movement, or 60%, 70%, 75%, 80%, or up to 100% of a user's weight during a pull-up movement. In some embodiments, the lift assistance feature of the device may be a bar or platform that a user stands upon, or may be a platform that a user kneels upon.

In yet another embodiment, the present invention provides a fitness device to support a human combination pull-up/fly movement, comprising a horizontal pull-up bar able to support a pull-up movement, wherein the horizontal pull-up bar comprises a right bar member and a left bar member, and wherein the right bar member and the left bar member are pivotally connected to the central pivot portion such that the right bar member and the left bar member may be resistively moved simultaneously in a fly movement. The device can be free-standing, suspended, or wall/door mountable.

In yet another embodiment, the invention provides a method of performing a pull-up/fly combination movement, comprising executing an upward pull-up movement using a horizontal pull-up bar; executing a fly movement by pivoting left and right members of the horizontal pull-up bar from an original position 180° relative to one another to a position 90° forward from the original position and back; and executing a downward pull-up movement using the horizontal pull-up bar.

DETAILED DESCRIPTION OF THE INVENTION

In the following description, numerous specific details are set forth to provide a more thorough understanding of the present invention. However, it will be apparent to one of skill in the art that the present invention may be practiced without one or more of these specific details. In other instances, well-known features and procedures well known to those skilled in the art have not been described in order to avoid obscuring the invention.

The present invention relates to an improved fitness device; specifically, the present invention relates to a fitness machine designed to strengthen multiple muscle groups including the abdominal, pectoralis, intercoastal, latissimus dorsi, rhomboid, trapezius, deltoid, tricep, bicep, forearm, oblique and gluteus maximus muscles using a unique, combination pull-up fly movement.

Figure 1:
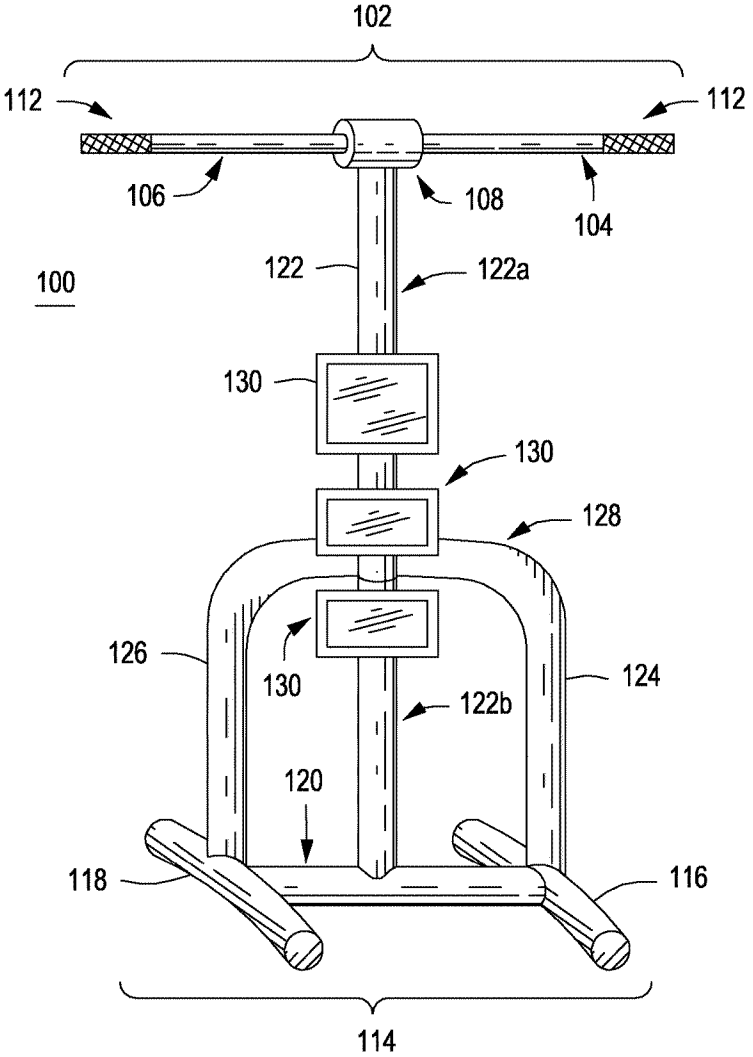
FIG. 1 is a front perspective view of one embodiment of a free standing combination pull-up/fly fitness device according to the invention.

FIG. 1 is a front perspective view of one embodiment of a free-standing combination pull-up/fly fitness device 100 according to the invention. Free-standing device 100 comprises a base 114 (floor engaging portion), which comprises in this embodiment a right floor engaging member 116 coupled by a cross floor engaging member 120 to a left floor engaging member 118. The cross floor engaging member 120 also couples the base 114 to central vertical support 122. Two general portions of central vertical support 122 are shown in FIG. 1: an upper region 122*a* of central vertical support 122 and a lower region 122*b* of central vertical support 122. In addition, the embodiment of the free-standing fitness device 100 shown in FIG. 1 additionally comprises a right outer vertical support 124 coupling the right floor engaging member 116 to a cross bar support member 128 and a left outer vertical support 126 coupling the left floor engaging member 118 to the cross bar support member 128. In alternative embodiments, the floor-engaging member comprises a front floor engaging member, a back floor engaging member and a cross floor engaging member that connect the front and back floor engaging members. Any configuration of the fitness device scaffold may be employed as long as the fitness device supports the horizontal pull-up bar comprising the right and left bar members, and allows the right bar member and the left bar member to be resistively moved simultaneously from an original position 180° relative to one another to a position 90° forward from the original position.

The upper region 122*a* of the central vertical support 122 is coupled to the horizontal pull-up bar 102 at central pivot portion 108. The horizontal pull-up bar 102 further comprises a right bar member 104 and a left bar member 106, where each of the right and left bar members includes a handle grip 112. Additionally, the embodiment of the free-standing combination pull-up/fly fitness device 100 shown in FIG. 1 further includes three back bracing plates (or back supports) 130.

The central pivot portion 108 of horizontal pull-up bar 102 comprises a mechanism that allows the right bar member 104 and left bar member or any variation of mechanical leverage 106 to be resistively moved simultaneously from an original position 180° relative to one another to a position substantially 90° from the original position. Resistance can be imparted using, e.g., free weights, pulley systems, springs, hydraulic and/or pneumatic systems as are known in the art. In the embodiment shown in FIG. 1, the resistive movement would be a movement 90° forward, or to the front of the device (that is, away from central vertical support 122.) In preferred embodiments, the mechanism requires that the resistive movement be substantially symmetrical.

In some embodiments, the free-standing combination pull-up/fly fitness device may include a step to allow users to step up to reach horizontal pull-up bar 102. In some embodiments, right bar member 104 and left bar member 106 may comprise multiple handle grip positions to accommodate different users. That is, there may be multiple handle grips 112 along each of right bar member 104 and left bar member 106. As for handle grips 112, in some embodiments, they can be adjusted, and in preferred embodiments handle grips 112 are made of a padded, non-slip material such as rubber, leather, foam rubber, plastic, and the like. In a preferred embodiment, the combination pull-up/fly fitness device will include forearm pads comprised of rubber, plastic, foam, or leather.

Thus, the combination pull-up/fly device of the present invention allows one to perform a unique pull-up/fly combination movement, comprising executing an upward pull-up movement using the horizontal pull-up bar; executing a fly movement by pivoting left and right members of the horizontal pull-up bar from an original position 180° relative to one another to a position 90° forward from the original position and back while in the upward pull-up position; and executing the downward pull-up movement using the horizontal pull-up bar.

Figure 2:
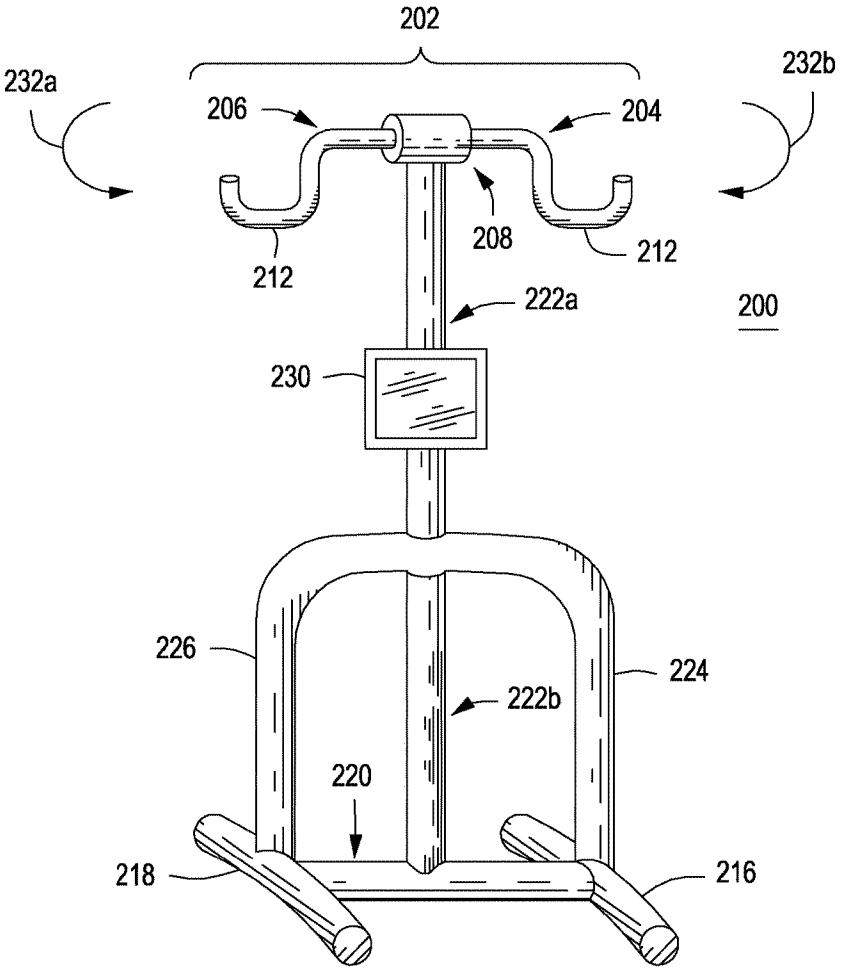
FIG. 2 is a front perspective view of another embodiment of a free standing combination pull-up/fly fitness device according to the invention.

FIG. 2 is a front perspective view of another embodiment of a free standing combination pull-up/fly fitness device according to the invention. As with the embodiment of the device shown in FIG. 1, free-standing device 200 comprises a base 214, comprising a right floor engaging member 216 coupled by a cross floor engaging member 220 to a left floor engaging member 218. The cross floor engaging member 220 couples the base 214 to central vertical support 222, where two general portions of central vertical support 222 are shown: an upper region 222*a* of central vertical support 222 and a lower region 222*b* of central vertical support 222. In addition, the free-standing fitness device 200 shown in FIG. 2 comprises a right outer vertical support 224 coupling the right floor engaging member 216 to a cross bar support member 228 and a left outer vertical support 226 coupling the left floor engaging member 218 to the cross bar support member 228. The upper region 222*a* of the central vertical support 222 is coupled to the horizontal pull-up bar 202 at central pivot portion 208. The horizontal pull-up bar 202 in this embodiment comprises a right bar member 204 and a left bar member 206 each of which has a stepped configuration, where each of the right and left bar members includes a handle grip 212 in the lowered portion of each of the right 204 and left 206 bar members. Additionally, the embodiment of the free-standing combination pull-up/fly fitness device 200 shown in FIG. 2 further includes one back bracing plate 230.

Figure 3:
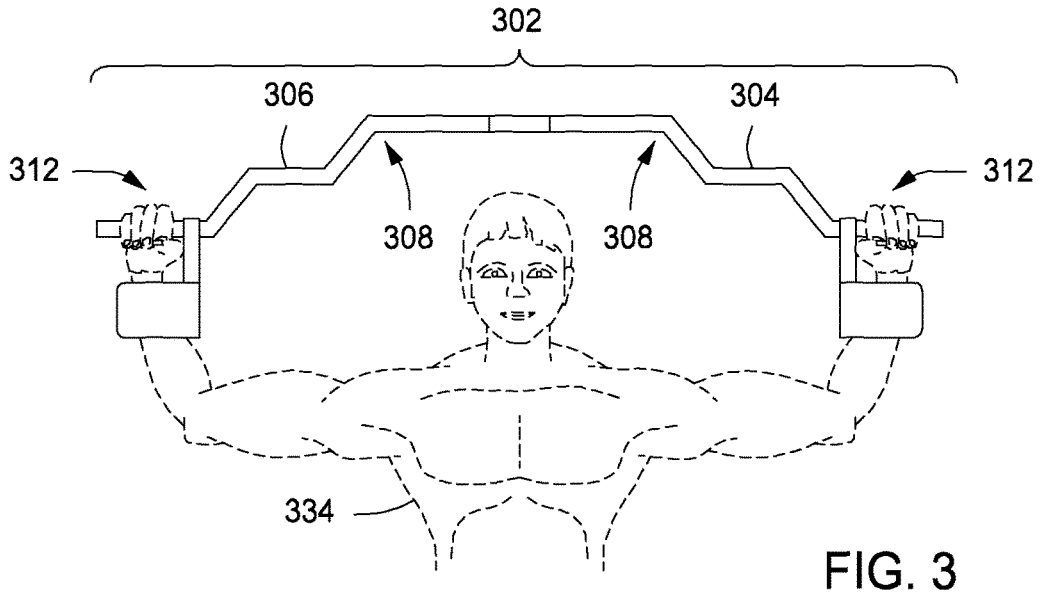
FIG. 3 is an environmental, front elevational view of one alternative embodiment of a horizontal pull-up bar according to the invention.

FIG. 3 is an environmental, front elevational view of one alternative embodiment of a horizontal pull-up bar according to the invention. FIG. 3 shows an alternative embodiment of the horizontal pull-up bar 302 comprising yet a different stepped configuration, with a central pivot portion 308 (which is coupled to the central vertical support, not shown), a right bar member 304 and a left bar member 306, where each of the right and left bar members includes a handle grip 312 in the lowered and distal portion of each of the right 304 and left 306 bar members. FIG. 3 shows an avatar 334 in a position where avatar 334 has completed the pull-up movement and has not yet begun the fly movement.

Figure 4A:
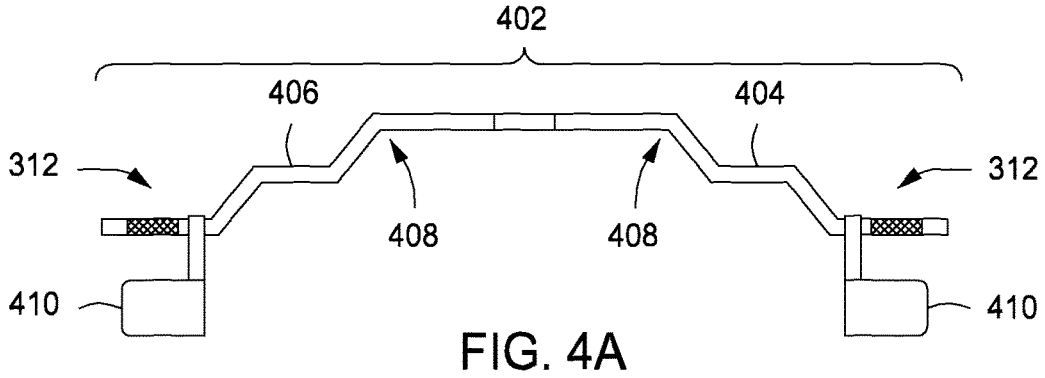
FIG. 4A is a front elevational view of yet another alternative embodiment of a horizontal pull-up bar according to the invention.
Figure 4B:
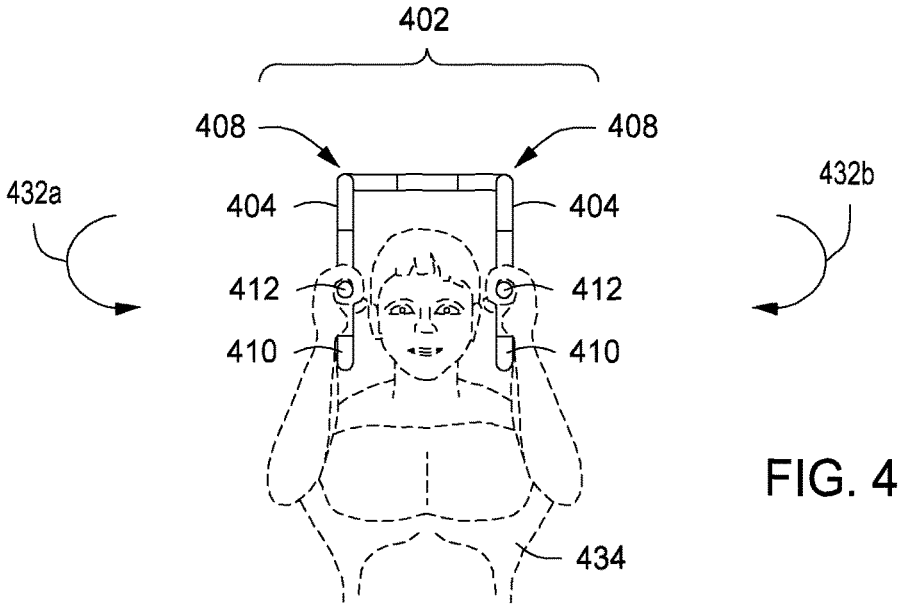
FIG. 4B is an environmental, front elevational view of the embodiment of the horizontal pull-up bar from FIG. 4A where the right and left bar members have been pivoted inward.

FIG. 4A is a front elevational view of the embodiment of the horizontal pull-up bar shown in FIG. 3. Again, horizontal pull-up bar 402 comprises a central pivot portion 408 (which would be coupled to the central vertical support, not shown), a right bar member 404 and a left bar member 406, where each right and left bar member includes a handle grip 412 in a lowered and distal portion of each of the right 404 and left 406 bar members. In addition, the horizontal pull-up bar 402 comprises forearm rests or braces 410 which may assist the user in performing the inward fly move. FIG. 4B is an environmental, front elevational view of the embodiment of the horizontal pull-up bar from FIG. 4A where the right and left bar members have been pivoted 90° inward relative to their initial position. Again, horizontal pull-up bar 402 comprises a central pivot portion 408 (which would be coupled to the central vertical support, not shown), a right bar member 404 and a left bar member 406, where each right and left bar member includes a handle grip 412 and forearm rests or braces 410. In addition, an avatar is shown at 434, where the avatar 434 has completed both the pull-up movement (as has the avatar in FIG. 3) and has completed the fly movement by pivoting the right and left bar members from their original position 180° from one another to 90° inward from their original position. Note that as with the other embodiments shown, the central pivot portion 408 comprises a mechanism that allows for pivoting of the right and left bar members inward in respect to the free-standing device 400 (denoted by arrows 432*a*, left to center, and 432*b*, right to center). As stated previously, resistance can be imparted using, e.g., free weights, pulley systems, springs, hydraulic and/or pneumatic systems as are known in the art.

Figure 5:
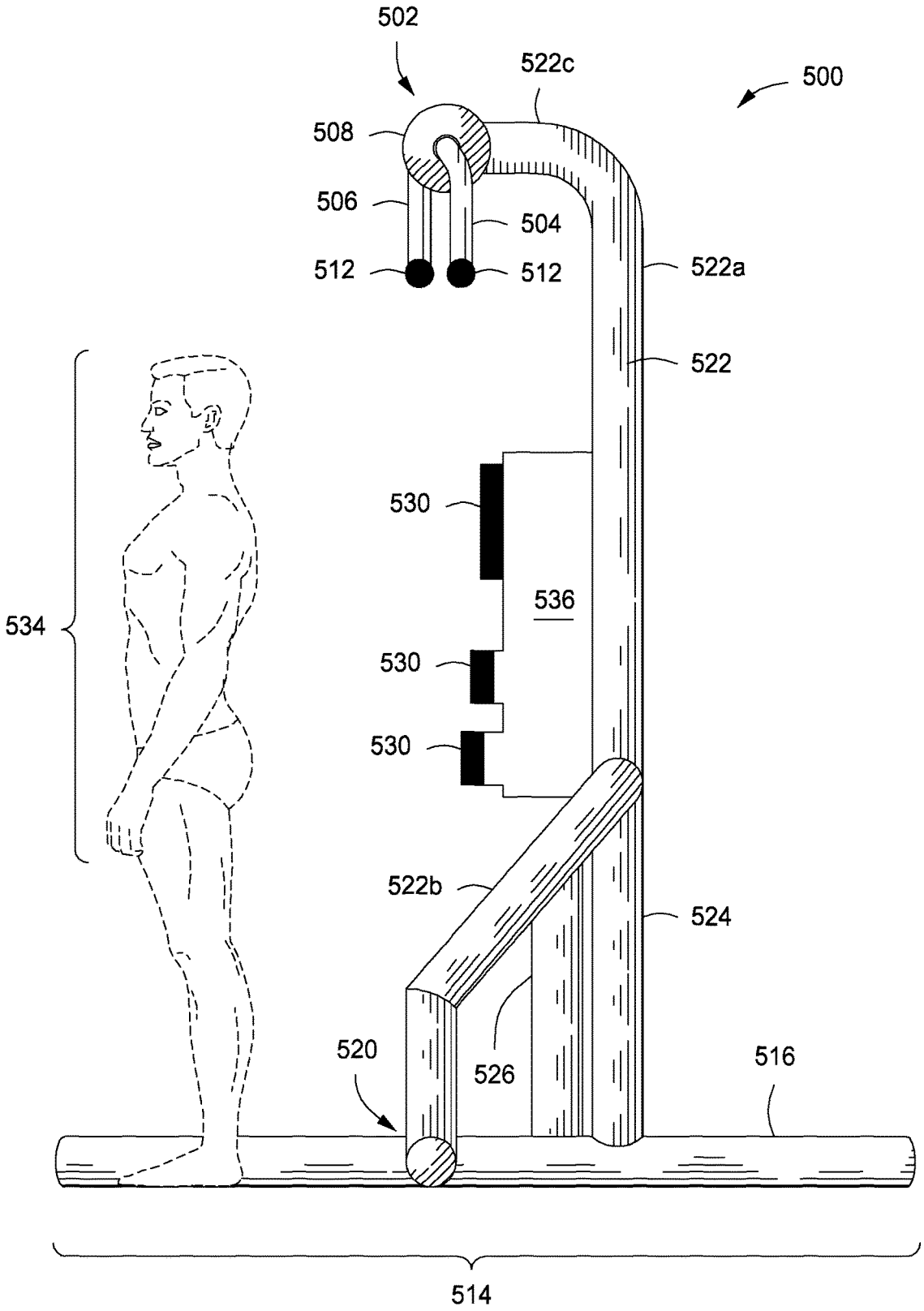
FIG. 5 is a right-hand side view of the free standing combination pull-up/fly fitness device embodiment shown in FIG. 1.

FIG. 5 is a right-hand side view of the free standing combination pull-up/fly fitness device embodiment shown in FIG. 1. Free-standing device 500 comprises a base 514 (floor engaging portion), which comprises in this embodiment a right floor engaging member 516 coupled by a cross floor engaging member 520 to a left floor engaging member (not seen in this embodiment). The cross floor engaging member 520 also couples the base 514 to the lower portion of central vertical support 522*b*. The free-standing fitness device 500 shown in FIG. 5 additionally comprises a right outer vertical support 524 coupling the right floor engaging member 516 to a cross bar support member (not seen) and a left outer vertical support 526 coupling the left floor engaging member (not seen) to the cross bar support member (not seen). The upper region 522*a* of the central vertical support 522 is bent from vertical to horizontal at portion 522*c*, and coupled with the horizontal pull-up bar 502 at central pivot portion 508. As is in the other embodiments shown, horizontal pull-up bar 502 comprises a right bar member 504 and a left bar member 506, where each of the left and right bar members includes a handle grip 512. Additionally, the embodiment of the free-standing combination pull-up/fly fitness device 500 shown in FIG. 5 further includes three back bracing plates (or back supports) 530 attached to a bracing plate support member 536.

Figure 6A:
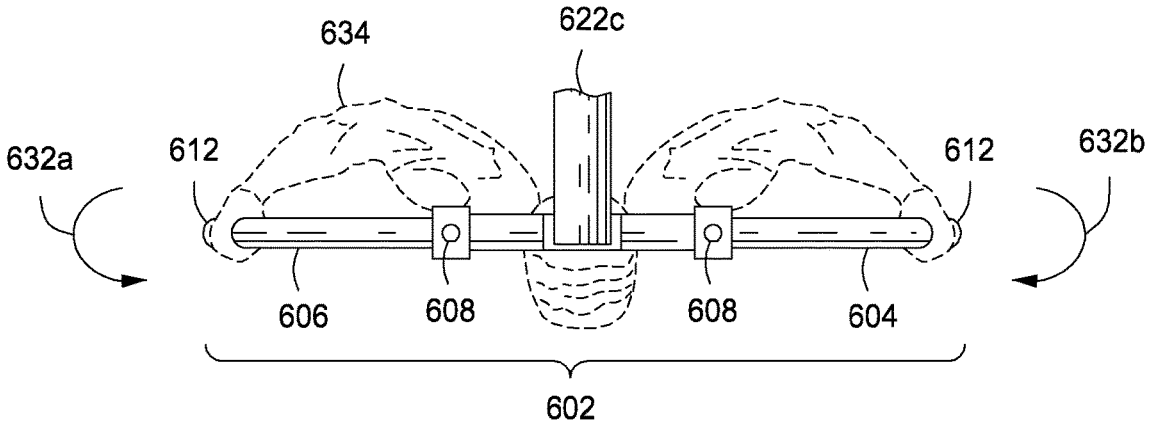
FIGS. 6A, 6B and 6C are top plan views showing full (FIGS. 6A and 6C) and partial (FIG. 6B) bar member positions.
Figure 6B:
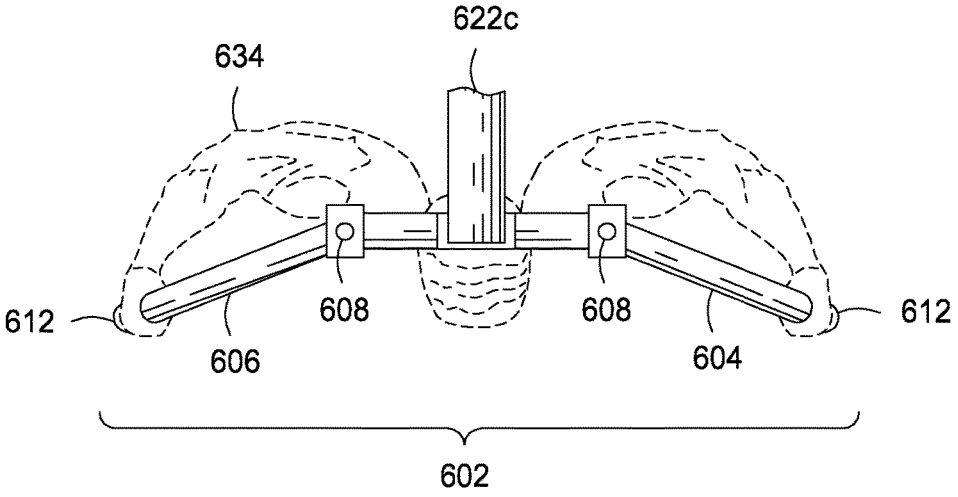
Figure 6C:
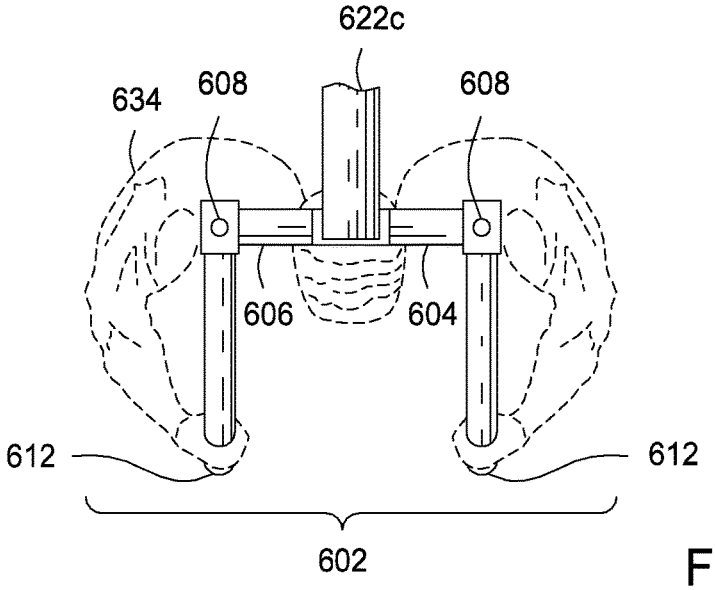

FIGS. 6A, 6B and 6C are top plan views showing full (FIGS. 6A (fully extended) and 6C (fully contracted)) and partial (FIG. 6B) left and right bar member positions. In FIG. 6A, horizontal pull-up bar 602 comprises a central pivot portion 608, which is coupled to the central vertical support at 622*c*, a right bar member 604 and a left bar member 606, with avatar 634 in position having completed a pull-up but not having begun the fly movement. Arrows 632*a* and 632*b* show the pivot movement that left and right bar members 606 and 604 will trace in the fly movement. FIG. 6B is a top plan view showing partial movement of the left and right bar members 606 and 604 partially pivoted from their original position 180° from one another on the way to a position 90° relative to their original position. Again, horizontal pull-up bar 602 comprises a central pivot portion 608, which is coupled to the central vertical support at 622*c*, a right bar member 604 and a left bar member 606, with avatar 634 in position having completed a pull-up and in the process of performing a fly movement. FIG. 6C is a top plan view showing partial movement of the left and right bar members 606 and 604 completely pivoted from their original position 180° from one another to a position 90° relative to their original position where avatar 634 has the completed fly movement contraction.

Figure 7A:
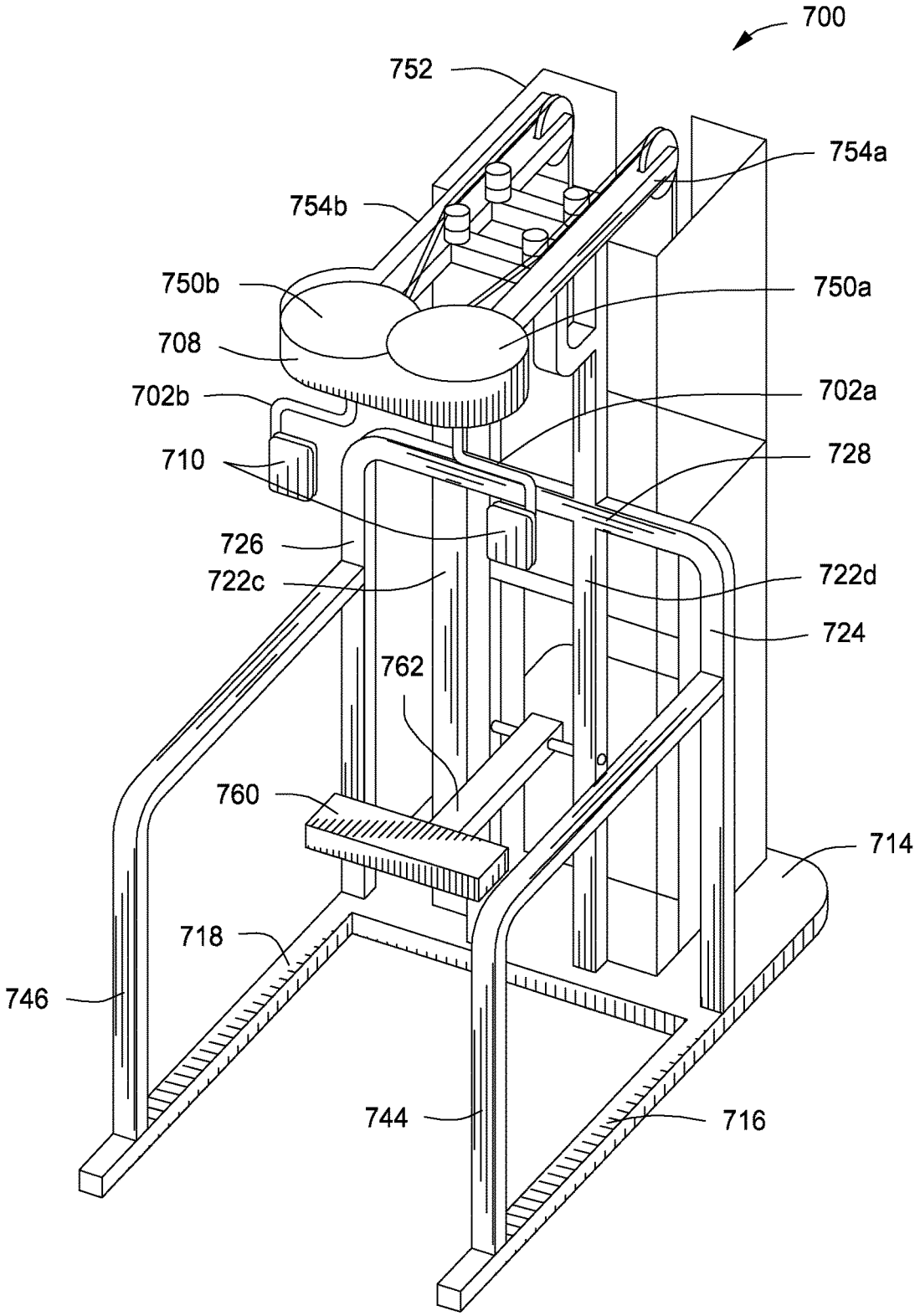
FIGS. 7A and 7B are side plan elevational views of yet another embodiment of a free standing combination pull-up/fly fitness device according to the invention.
Figure 7B:
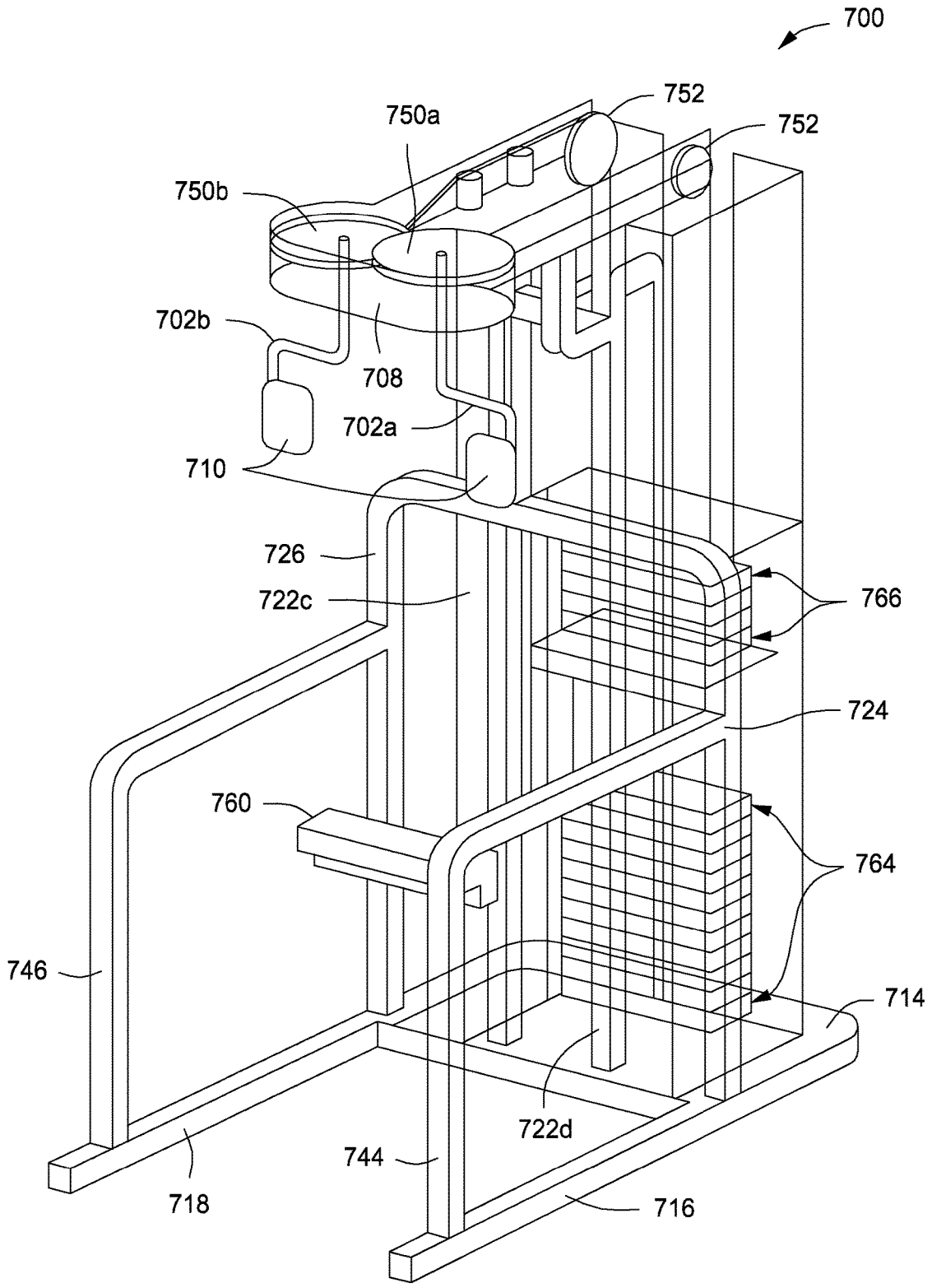
Figure 7C:
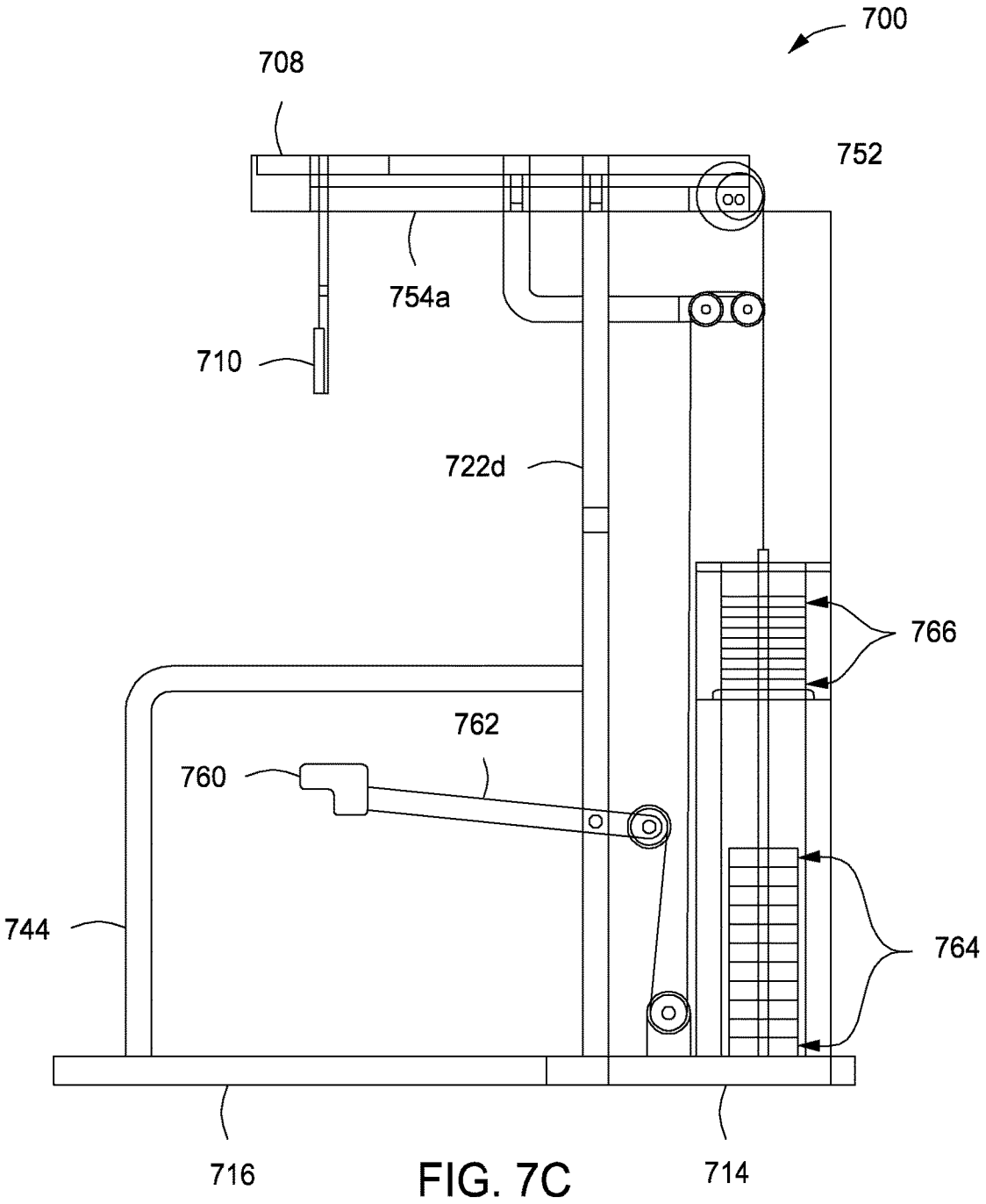
FIG. 7C is a side view of the embodiment shown in FIGS. 7A and 7B.

FIGS. 7A, 7B and 7C are side elevation views of yet another embodiment of a free standing combination pull-up/fly fitness device according to the invention. FIG. 7A shows a free-standing device 700 comprising a base 714 (floor engaging portion), which comprises in this embodiment a right floor engaging member 716 and a left floor engaging member 718. The base 714 is coupled to, in this embodiment, two central vertical supports 722*d* and 722*e*. In addition, the embodiment of the free-standing fitness device 700 shown in FIG. 7 comprises a right outer vertical support 724 coupling the right floor engaging member 716 to one central vertical support 722*d* and a left outer vertical support 726 coupling the left floor engaging member 718 to the other central vertical support 722*e*. In addition, FIG. 7A shows a second right outer vertical support 744 and a left outer vertical support at 746 which couple right floor engaging member 716 to right outer vertical support 724 and left floor engaging member 718 to left outer vertical support 726, respectively. As stated previously, any configuration of floor-engaging members, vertical supports, horizontal supports, etc., may be employed as long as the fitness device supports the horizontal pull-up bar comprising the right and left bar members, and allows the right bar member and the left bar member to be resistively moved simultaneously from an original position 180° relative to one another to a position 90° from the original position.

The upper region of the central vertical supports 722*d* and 722*e* are coupled to horizontal bars 754*a* and 754*b*, which are in turn are coupled with central pivot portion 708. Central pivot portion 708 comprises right pulley wheel mechanism 750*a* and left pulley wheel mechanism 750*b* that are integral parts of a pulley/weight system used to provide weight resistance in this embodiment. Right pulley wheel mechanism 750*a* is coupled to and controls right horizontal pull-up bar 702*a* and left pulley wheel mechanism 750*b* is coupled to and controls left horizontal pull-up bar 702*b*. Note that in this embodiment, there are essentially two horizontal pull-up bars (that is, there are two separate horizontal pull-up bar members), right horizontal pull-up bar 702*a* and left horizontal pull-up bar 702*b*. Note that both right horizontal pull-up bar 702*a* and left horizontal pull-up bar 702*b* comprise forearm braces 710. Note that one secondary pulley wheel 752 is shown in FIG. 7A, as an interior mechanism in left horizontal bar 754*b*.

Note that FIG. 7A also comprises a lift assist bar 760, which allows a user to kneel on lift assist bar 760 to have a percentage of the user's weight supported during the combined pull-up/fly motion. Lift assist bar 760 is coupled to weights by weight support lever 762. Lift assist mechanisms are known in the art, for example, see U.S. Pat. No. 5,372,556 to Ropp. The embodiment shown here supports a user in a kneeling position; however, in other embodiments, a lift mechanism may support users in a standing position. In the embodiments shown in FIG. 7A, a user would face central vertical supports 722*d* and 722*e*, kneel upon lift assist bar 760, grab right horizontal pull-up bar 702*a* and left horizontal pull-up bar 702*b*, and pivot right horizontal pull-up bar 702*a* and left horizontal pull-up bar 702*b* inwardly toward central vertical supports 722*d* and 722*e*.

FIG. 7B is an x-ray side plan elevational view of the free-standing device 700 from FIG. 7A. FIG. 7B shows base 714 (floor engaging portion), which comprises a right floor engaging member 716 and a left floor engaging member 718. The base 714 is coupled to two central vertical supports 722*d* and 722*e*. In addition, the embodiment of the free-standing fitness device 700 shown in FIG. 7B comprises a right outer vertical support 724 coupling the right floor engaging member 716 to one central vertical support 722*d* and a left outer vertical support 726 coupling the left floor engaging member 718 to the other central vertical support 722*e*. FIG. 7B shows a second right outer vertical support 744 that couples right floor engaging member 716 to right outer vertical support 724 and a left outer vertical support at 746 that couples left floor engaging member 718 to left outer vertical support 726.

The upper region of central vertical supports 722*d* and 722*e* are coupled to horizontal bars 754*a* and 754*b* (not shown), which are in turn coupled with central pivot portion 708. Central pivot portion 708 comprises right pulley wheel mechanism 750*a* and left pulley wheel mechanism 750*b*. Right pulley wheel mechanism 750*a* is coupled to and controls right horizontal pull-up bar 702*a* and left pulley wheel mechanism 750*b* is coupled to and controls left horizontal pull-up bar 702*b*. Again, there are essentially two separate horizontal pull-up bars (separate horizontal pull-up bar members), right horizontal pull-up bar 702*a* and left horizontal pull-up bar 702*b*. Note that the free-standing combination pull-up/fly device shown in FIG. 7B also employs a pulley/weight system and both right horizontal pull-up bar 702*a* and left horizontal pull-up bar 702*b* comprise forearm braces 710. Note that here both secondary pulley wheels 752 are shown. The secondary pulley wheels 752 are coupled to weights 766, which allows a user to adjust the resistance of the fly movement.

Note that FIG. 7B also comprises a lift assist bar 760, which allows a user to kneel on lift assist bar 760 to have a percentage of the user's weight supported during the combined pull-up/fly motion. Lift assist bar 760 is coupled to weights 764 by weight support lever 762. Weights 764 allow a user to adjust the amount of lift resistance provided.

FIG. 7C is a side view of the free-standing device 700 from FIGS. 7A and 7B. FIG. 7C shows base 714 (floor engaging portion), which comprises a right floor engaging member 716 and a left floor engaging member 718 (not shown). The base 714 is coupled to two central vertical supports 722*d* and 722*e* (not shown). FIG. 7C shows a second right outer vertical support 744 that couples right floor engaging member 716 to right outer vertical support 724 (not shown). The upper region of the central vertical support 722*d* is coupled to horizontal bar 754*a*, which is in turn coupled with central pivot portion 708. Central pivot portion 708 is coupled to and controls right horizontal pull-up bar 702*a* (not shown), which comprises forearm brace 710. Note that here the right secondary pulley wheel 752 is shown. The secondary pulley wheel 752 is coupled to weights 766, which allows a user to adjust the resistance of the fly movement.

FIG. 7C comprises a lift assist bar 760, which allows a user to kneel on lift assist bar 760 to have a percentage of the user's weight supported during the combined pull-up/fly motion. Lift assist bar 760 is coupled to weights 764 by weight support lever 762.

Note that the embodiments of the free standing combination pull-up/fly fitness device shown in FIGS. 7A, 7B and 7C utilize a pulley and weight system to adjust the resistance for the fly movement and the lift assist mechanism; however, other systems known in the art may be used as an alternative, including, e.g., hydraulic systems, spring systems, and pneumatic systems.

Figure 8:
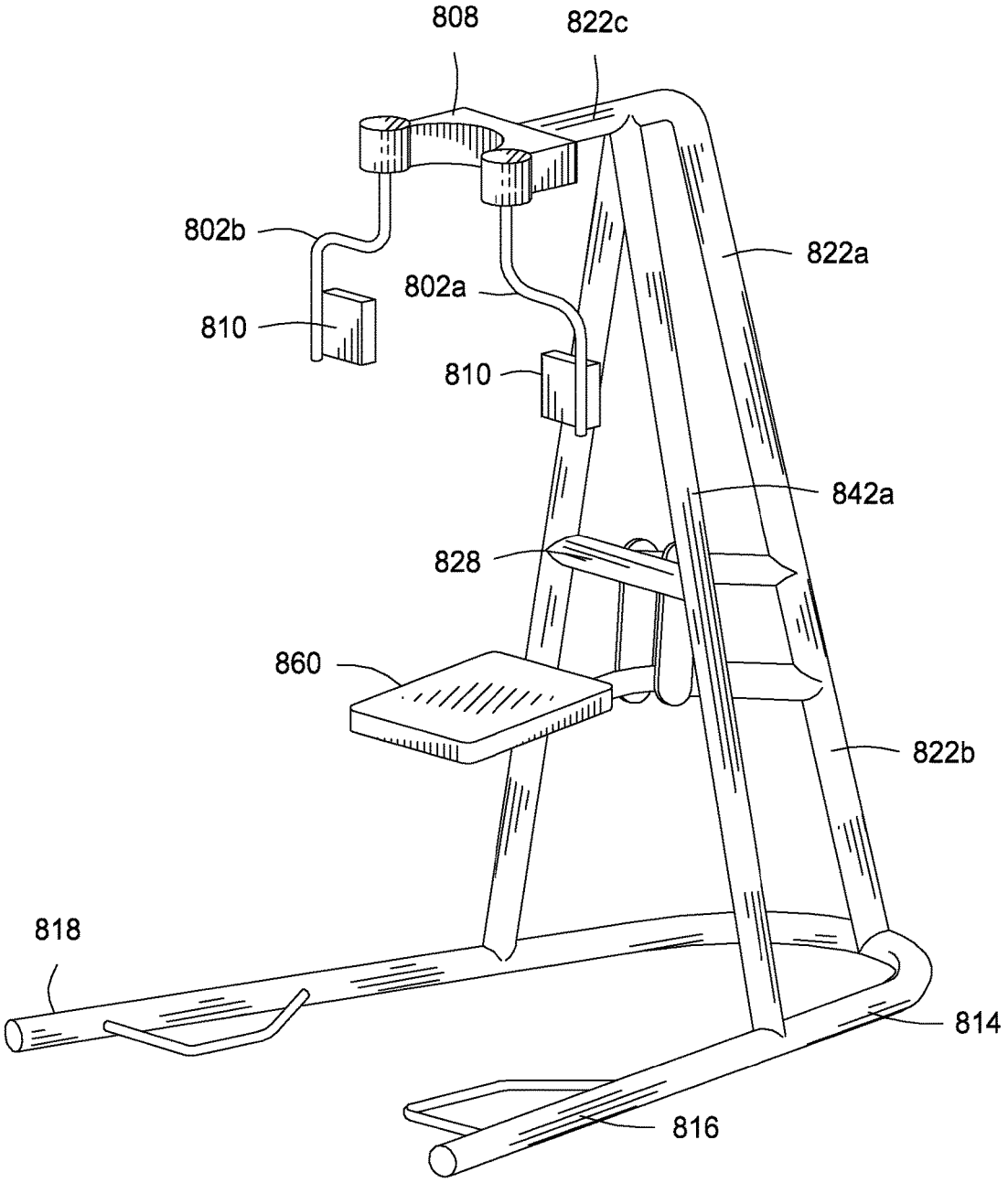
FIG. 8 is yet an additional embodiment of a free standing combination pull-up/fly fitness device designed for home use according to the invention.

FIG. 8 is a side plan view of yet an additional configuration of a combination pull-up/fly fitness device 800. FIG. 8 shows base 814 (floor engaging portion), which comprises and is contiguous with a right floor engaging member 816 and a left floor engaging member 818. The right floor engaging member 816 and a left floor engaging member 818 are coupled to two central vertical supports 842*a* and 842*b*, which, in conjunction with central vertical member 822, form a tripartite vertical support for device 800. The upper region of the central vertical support 822*a* is coupled to horizontal support 822*c*, which is in turn coupled with central pivot portion 808. Central pivot portion 808 is coupled to and controls right horizontal pull-up bar 802*a*, which comprises a forearm brace 810, and left horizontal pull-up bar 802*b*, which also comprises a forearm brace 810. The embodiment of the combination pull-up/fly fitness device shown in FIG. 8 comprises a lift assist bar 860, which allows a user to kneel on lift assist bar 860 to have a percentage of the user's weight supported during the combined pull-up/fly motion. Lift assist bar 860 is coupled to weight support lever 862.

The preceding merely illustrates the principles of the invention. It will be appreciated that those skilled in the art will be able to devise various arrangements which, although not explicitly described or shown herein, embody the principles of the invention and are included within its spirit and scope. Furthermore, all examples and conditional language recited herein are primarily intended to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims. In the claims that follow, unless the term "means" is used, none of the features or elements recited therein should be construed as means-plus-function limitations pursuant to 35 U.S.C. §112, ¶6.

We claim:

1. A free-standing fitness device for use in performing a combination pull-up and fly move, comprising:

a floor engaging member coupled to a central vertical support; and a horizontal pull-up bar able to support at least 400 pounds of weight and configured to support a human pull up movement, securely coupled by a central pivot portion to the central vertical support at a height of at least 5' 9" from the floor engaging member, wherein the horizontal pull-up bar comprises a right bar member and a left bar member, wherein the right bar member and the left bar member are pivotally connected to the central pivot portion such that the right bar member and the left bar member are configured to be resistively moved simultaneously from an original position 180° relative to one another to a position 90° forward from the original position while a user is performing a fly movement, and wherein the free-standing fitness device further comprises a right pulley mechanism coupled to the right bar member and a left pulley mechanism coupled to the left bar member to provide weight resistance.

2. The free-standing fitness device of claim 1, further comprising lift assistance able to support up to 50% of the user's weight during a pull-up movement.

3. The free-standing fitness device of claim 2, further comprising lift assistance able to support up to 60% of the user's weight during a pull-up movement.

4. The free-standing fitness device of claim 3, further comprising lift assistance able to support up to 70% of the user's weight during a pull-up movement.

5. The free-standing fitness device of claim 4, further comprising lift assistance able to support up to 80% of the user's weight during a pull-up movement.

6. The free-standing fitness device of claim 2, further comprising at least two back bracing plates.

7. The free-standing fitness device of claim 1, wherein the floor engaging member comprises a right floor engaging member, a left floor engaging member and a cross floor engaging member that couples the right and left floor engaging members.

8. The free-standing fitness device of claim 7, wherein the central vertical support member further comprises a left outer vertical support, a right outer vertical support and a cross bar support, wherein the cross bar support couples the central vertical support member to the left outer vertical support and the right outer vertical support.

9. The free-standing fitness device of claim 8, wherein the right outer vertical support is coupled to the right floor engaging member, and the left outer vertical support is coupled to the left floor engaging member.

10. The free-standing fitness device of claim 1, further comprising at least one back bracing plate.

11. The free-standing fitness device of claim 1, wherein the right and left bar members comprise handle grips.

12. The free-standing fitness device of claim 1, wherein the right and left bar members comprise forearm rests.

13. The free-standing fitness device of claim 1, wherein the horizontal pull-up bar is securely coupled to the central vertical support at a height of substantially 5' 11" from the floor engaging members.

14. The free-standing fitness device of claim 1, wherein the horizontal pull-up bar is able to support at least 600 pounds of weight.

15. A method of performing a pull-up/fly combination movement using the free-standing fitness device of claim 1, comprising executing an upward pull-up movement using the horizontal pull-up bar; executing a fly movement by pivoting the left and right bar members of the horizontal pull-up bar from an original position 180° relative to one another to a position 90° forward from the original position and back; and executing a downward pull-up movement using the horizontal pull-up bar.

16. A fitness device for use in performing a combination pull-up and fly move, comprising: a floor engaging member coupled to a central vertical support; and a horizontal pull-up bar able to support at least 500 pounds of weight and configured to support a human pull up movement, securely coupled by a central pivot portion to the central vertical support at a height of at least 5' 11" from the floor engaging member, wherein the horizontal pull-up bar comprises a right bar member and a left bar member, wherein each of the right bar member and left bar member comprise a handle grip, wherein the right bar member and the left bar member are pivotally connected to the central pivot portion such that the right bar member and the left bar member are configured to be resistively moved simultaneously and symmetrically from an original position 180° relative to one another to a position 90° forward from the original position while a user is performing a fly movement, and wherein the free-standing fitness device further comprises a right pulley mechanism coupled to the right bar member and a left pulley mechanism coupled to the left bar member to provide weight resistance.

17. The fitness device of claim 16, wherein the fitness device is free-standing, suspended and/or wall/door mountable.

18. A method of performing a pull-up/fly combination movement using the free-standing fitness device of claim 16, comprising executing an upward pull-up movement using the horizontal pull-up bar; executing a fly movement by pivoting the left and right bar members of the horizontal pull-up bar from an original position 180° relative to one another to a position 90° forward from the original position and back; and executing a downward pull-up movement using the horizontal pull-up bar.

19. A free-standing fitness device comprising a horizontal pull-up bar able to support a human pull-up motion, wherein the horizontal pull-up bar comprises a right bar member and a left bar member, and wherein the right bar member and the left bar member are pivotally connected to a central pivot portion such that the right bar member and the left bar member may be resistively moved simultaneously while a user performs a human fly movement, and wherein the free-standing fitness device further comprises a right pulley mechanism coupled to the right bar member and a left pulley mechanism coupled to the left bar member to provide weight resistance.

20. A method of performing a pull-up/fly combination movement using the free-standing device of claim 19, comprising executing an upward pull-up movement using the horizontal pull-up bar; executing a fly movement by pivoting the left and right bar members of the horizontal pull-up bar from an original position 180° relative to one another to a position 90° forward from the original position and back; and executing a downward pull-up movement using the horizontal pull-up bar.

21. A method of performing a pull-up/fly combination movement using the free-standing device of claim 19, comprising executing an upward pull-up movement using the horizontal pull-up bar; executing a fly movement by pivoting the left and right bar members of the horizontal pull-up bar from an original position to a position forward from the original position and back; and executing a downward pull-up movement using the horizontal pull-up bar.

* * * * *